United States Patent [19]

Ishizuka

[11] Patent Number: 4,699,704

[45] Date of Patent: Oct. 13, 1987

[54] ELECTROLYTIC CELL FOR A MOLTEN SALT

[76] Inventor: Hiroshi Ishizuka, 19-2, Ebara 6-chome, Shinagawa-ku, Tokyo, Japan

[21] Appl. No.: 823,405

[22] Filed: Jan. 28, 1986

[30] Foreign Application Priority Data

Feb. 13, 1985 [JP] Japan ..... 60-25867

[51] Int. Cl.[4] ..... C25C 3/02; C25C 7/00

[52] U.S. Cl. ..... 204/243 R; 204/247; 204/272; 204/284; 204/289; 204/68; 204/70

[58] Field of Search ..... 204/243 R–247, 204/252, 260, 68–70, 284, 272, 289

[56] References Cited

U.S. PATENT DOCUMENTS

| | | | |
|---|---|---|---|
| 1,486,546 | 3/1924 | Rhodin | 204/70 |
| 1,569,606 | 1/1926 | Ashcroft | 204/244 X |
| 1,921,376 | 8/1933 | Ward | 204/247 |
| 2,194,443 | 3/1940 | Hardy et al. | 204/247 |
| 4,511,440 | 4/1985 | Saprokhin et al. | 204/247 X |
| 4,613,414 | 9/1986 | Sivilotti et al. | 204/284 X |

*Primary Examiner*—Donald R. Valentine
*Attorney, Agent, or Firm*—Larson and Taylor

[57] ABSTRACT

An electrolytic cell for a molten salt comprising alkali- or alkaline earth metal chloride, comprising: an assembly of anode and cathode in opposed relation with each other, a tightly closable vessel containing said assembly and capable of holding in molten state a salt comprising an alkali- or alkaline earth metal chloride, an insulative partition arranged around the anode and extending axially over a height range including the intended bath level, several projections formed to a length on an effective side of the anode opposed to the cathode, said projection having upper and lower surfaces declining outwards so an open bottom-closed top space is provided under each projection, a rise bore formed lengthwise within the anode to run along the axis and a lateral hole in communicating relation with an inward ascent between said space and rise bore.

9 Claims, 3 Drawing Figures

ELECTROLYTIC CELL FOR A MOLTEN SALT

Figure 1:
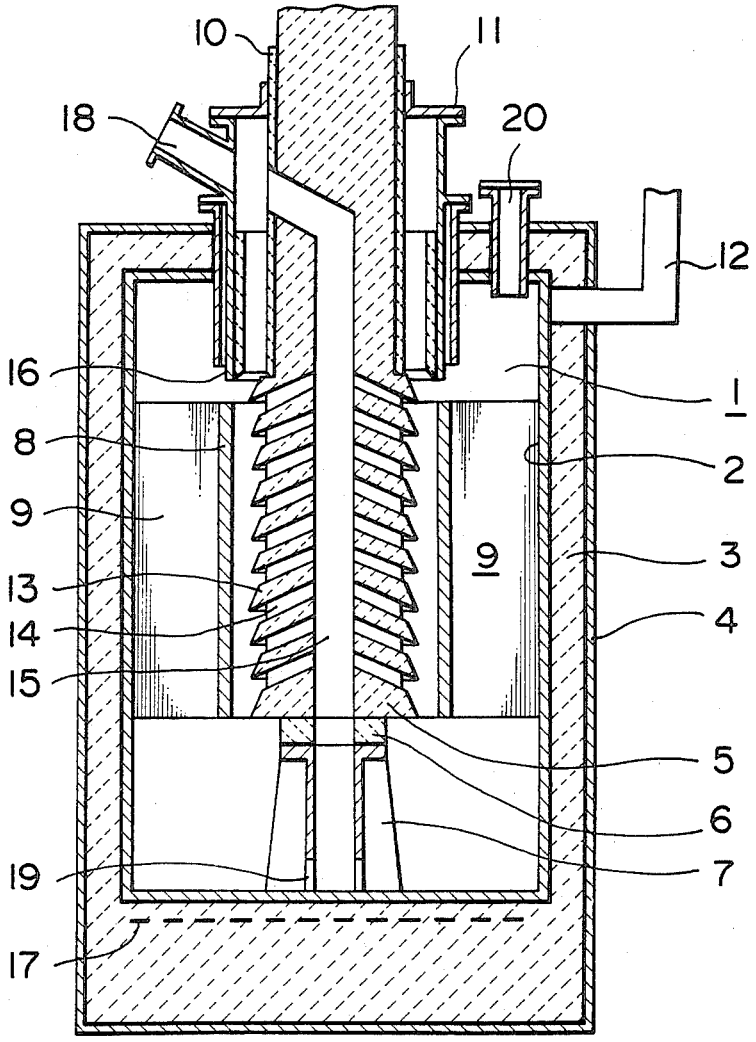

The present invention relates to a cell for an electrolytic production of chlorine and metal from, in particular, a molten salt comprising a chloride of alkali- or alkaline earth metal.

Cell arrangements have been heretofore known and employed for the electrolytic production on commercial scale of alkali- and alkaline earth metals, such as lithium and magnesium, from a chloride thereof in molten state. They comprise generally one or more assemblies of anode and cathode, contained in a closed vessel, without any (parallel type)—or with one or more intermediate bipolar electrodes provided between the anode and cathode (serial type). Improved power efficiency is desirable and can be achieved by—or if arranging the electrodes at decreased interelectrode spacings by effectively keeping bubbles of chlorine, which is a by-product forming on the anodic sides, off from the cathodic sides where the metallic product deposits. Several arrangements have been proposed and published for this purpose. For example, U.S. Pat. No. 4,055,474 describes a parallel electrode arrangement in which flat electrodes are arranged with the opposed sides of the anode and cathode upward diverted from each other for the purpose of compensating the upward spread of the chlorine and, thereby, decreasing the metal-gas contact. U.S.S.R. inventor certificate No. 398,690 describes an arrangement which comprise an anode member which is provided therewithin with an inwards ascending duct and a vertical bore connected tangentially therewith, thus allowing the chlorine gas to be guided out from the anode surface where it has formed, through the channel thus provided. On the other hand, French Patent No. 70 23962 (Publication No. 2 049 201) describes a serial arrangement in which the electrodes have such inclined effective sides such that the anodic side lies upwards the cathodic.

Even those cells are still to be improved in yield of products: there is some chlorine left unrecovered in the interelectrode gaps and reaching the cathodic sides to cause loss of product by recombination.

Therefore one of the principal objects of the present invention is to provide an improved electrolytic cell design whereby the chlorine gas, and therefore the metallic product too, is recovered at an increased efficiency from the anodic sides where the gas has formed, thus allowing the interelectrode spacing and, accordingly, the power consumption to be much reduced. The invention further contemplates a much increased productivity per given area of plant floor, by using the much increased height dimension now available of the electrodes in addition to the decreased interelectrode spacing.

According to the invention there is provided a cell for a molten salt comprising: alkali- or alkaline earth metal chloride, comprising: an assembly of anode and cathode in opposed relation with each other, a tightly closable vessel containing said assembly and capable of holding in molten state a salt comprising an alkali—or alkaline earth metal chloride, an insulative pertition arranged around the anode and extending axially over a height range including the intended bath level, several projections formed to a length on an effective side of the anode opposed to the cathode, said projection having upper and lower surfaces declining outwards so an open bottom-closed top space is provided under each projection, a rise bore formed lengthwise within the anode to run along the axis, and a latreral hole in communicating relation with an inward ascent between said space and rise bore.

As described above the anode member has thereon several projections on the base body of the electrode, said projections typically exhibiting as a whole a jalousie-like appearance, composed of either a vertical series or continuous spiral of outwards declining overhangs. The projection in axial cross section forms a rounded or somewhat straight upper profile or thie mix, inclined at a tangential close at 90° and, at least, 60° to the horizontal in the outermost region, in order to give an optimal separation of chlorine bubbles from the electrode surface. The lower surface of the projection has suitably an inclination ranging between 10° and 40°. An excessive inclination may further improve the chlorine removal but only at the cost of a decreased strength of the projection and, thus, a decreased service life of this electrode. The space between adjacent projections is preferably formed inwards convergent.

Chlorine gas is formed on the anode surface, accumulated in the collection space, guided, along with some of the bath, through a communication channel inwards within the electrode member and into the rise channel which extends lengthwise, and to outside the cell for recovery. The bath substantially unloaded of the chlorine gas is allowed to join back the rest of the bath for further process through an open top of said rise channel, or with the channel constructed adequately large in diameter or cross section, the bath may be allowed to flow down an inner portion of said channel. The anode member may be constructed of either a flat slab or a cylindrical shaft of, for example, graphite, the latter being preferable for easier fabrication. The projections may be arranged stepwise at different levels across the flat surface or about the cylindrical base body of the electrode. Variations include a spirally extending projection on the cylindrical surface. Machining techniques conventionally employed in the art are available for the fabrication of the anode with such projections.

Several cathode constructions may be employed for the cell of the invention. For example, the cathode may be simply a flat or cylindrical sheet of steel arranged substantially in parallel or coaxially with the anode.

Other variations are known from U.S. Pat. No. 4,401,543 which describes a flat cathode which comprises a series of several lateral strips of steel, each joined in a common plane or at a common angle to the top of threaded bolts which, in turn, have been turned into a slab of graphite. A cylindrical cathode may be also be constructed of a series of straight or, better, conical rings of steel which are arranged to be downward convergent so the metallic product forming thereon may be guided backwards through gaps provided between adjacent rings and the contact with chlorine may be minimized during the recovery.

As well experienced the service life of a cell depends to some degree on that of the electrodes and other consumable members arranged in a location hard to access. Thus it is desirable that the vessel should be basically made of steel, and contain thereinside least or no members at all of less resistant material such as refractories.

The electrolytic cell construction of the invention allows to substantially decrease the chlorine proportion to be left unrecovered and to spread in the interelectrode spaces, by intercepting the gas under the overhang provided just over the site of formation and, thereby, a substantially reduced interelectrode spacing less than 30 mm is available, as well as an increased effective height or length of the electrode reaching more than 1 m.

Figure 2:
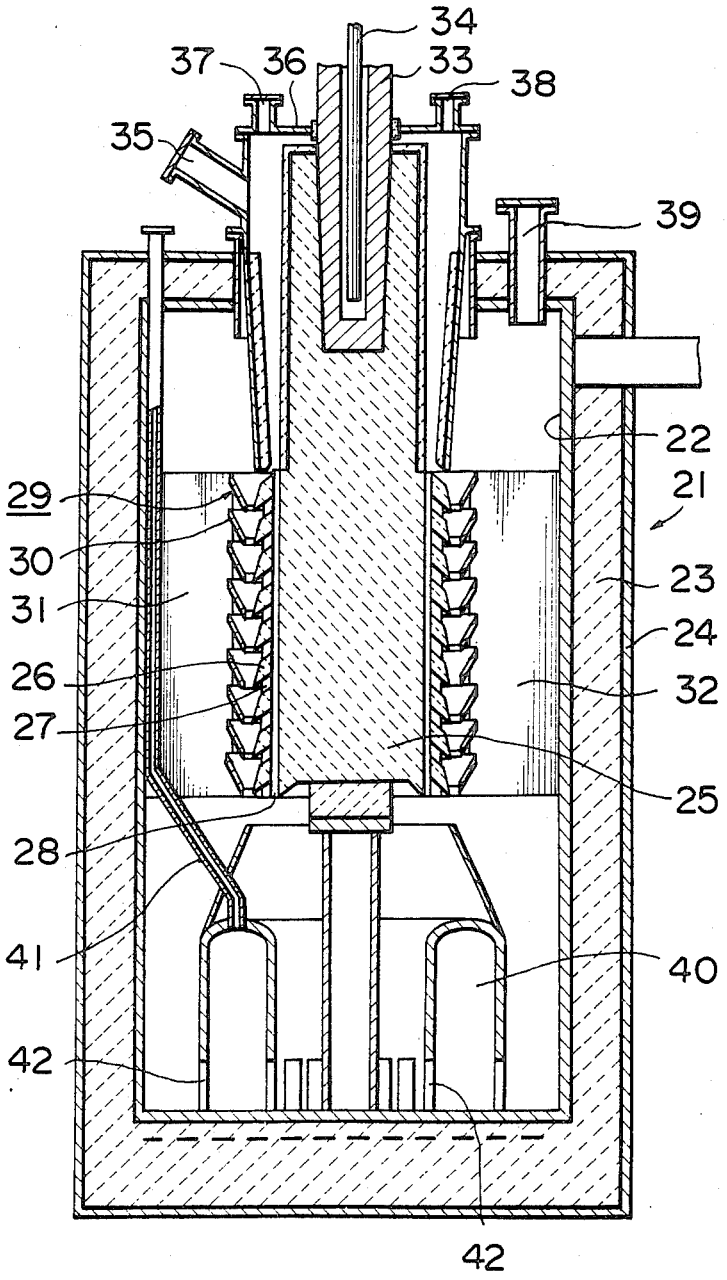
Figure 3:
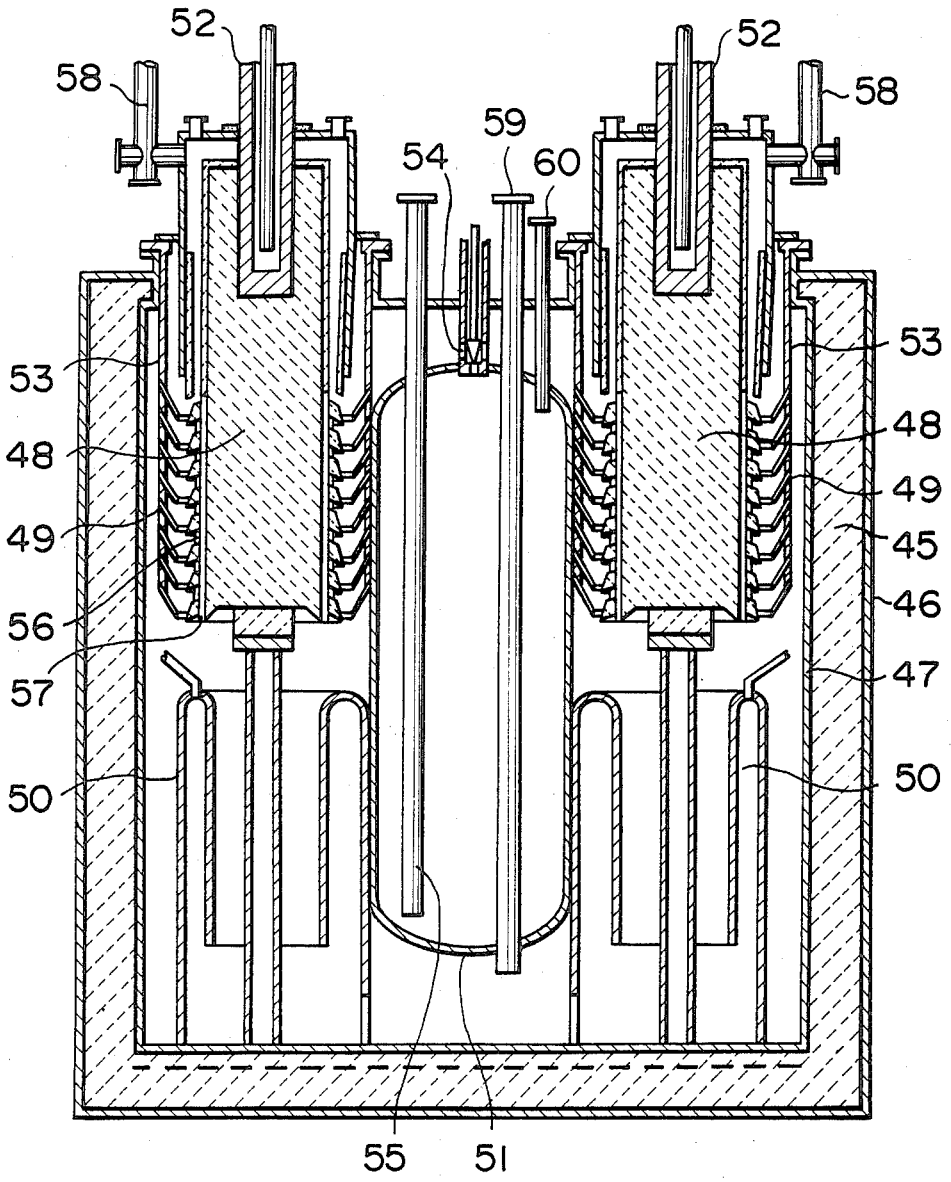

Now the invention will be described more in detail in reference with the attached drawing which is given merely by way of example, in which:

FIG. 1 is an elevation in section of an electrolytic cell realized according to the invention and adapted for a molten salt comprising LiCl or $MgCl_2$; and FIGS. 2 and 3 show elevations in section of a few of variations which additionally comprise a bath level regulating device and, further, a metal collecting chamber to be immersed in the bath.

The cell shown in FIG. 1, in particular, comprises an electrolytic chamber 1 substantially defined by a closed cylindrical vessel of iron material 2, which in turn is provided thereon with an insulative coat 3 of, for example, refractory bricks or ceramic fiber and a shell 4 of steel. An anode 5 of substantially cylindrical construction is arranged substantially in coaxial relation with the vessel 1 seated on a stand 7 of carbon or stainless steel and insulated therefrom with a refractory block 6. Around the anode 5 there is arranged coaxially a thin-walled cylindrical or tubular cathode 8 of iron material, supported on the vessel 2 wall by means of several plates of iron 9, which also serve to conduct electricity to the electrode 8. The anode 5 may have thereon an insulative coat 10 in the region above the cathode top for better suppression of current leakage. For power supply the anode 5 has an upper portion extending over a lid 11, while a cathodic lead 12 is connected on the vessel 2 wall in an upper portion. With the vessel thus consisting partly the current path, an adequate insulation essentially is provided somewhere between both terminals, for example, on the anode surface or between the lid and other vessel members. The anode has in series stepwise formed several annular or more precisely, substantially conical projections typically designated at 13, on the effective surface opposed to the cathode. The lower surface of the projection has an inward ascent for guiding inwards the chlorine, while the upper surface in the outermost region has an inclination towards an inner portion for an efficient removal of chlorine bubbles from the electrode surface. In the body of the anode between adjacent projections 13, several lateral holes, typically designated at 14, are formed with one end open on the periphery at somewhat regular angular interval, while they are joined at the inner end to a rise bore 15, formed to extend, conveniently, vertically along the axis.

A sleeve 16 of steel plate-reinforced refractory is arranged coaxially around the anode in order to minimize current leakage through a metal afloat the bath. While the vessel 2 has the insulative coat covering regularly the substantial part of the body from the view point of the heat economy, the insulative layer could be reduced in thickness or, further, provided with a water jacket in a region thereof around the cathode in order to forcibly remove excessive heat when an increased current input is applied, if desired, for a higher productivity. A heater 17 close to the vessel bottom allows to hold the electrolyte bath at proper temperature levels during the process with least temperature difference along the axis.

Chlorine gas, electrolytically deposited on the anode surface, rises along the projections. The gas reaches the rise bore 15 through the holes 14 and keeps rising until it leaves the bath and it is exhausted through a gas outlet 18. The bath thus unloaded of the gas flows down in the bore 15 and comes out through openings 19 at the bottom of the stand 7 to join the major portion of the bath. The metallic product forming on the cathodic surface, on the other hand, rises in the interelectrode clearance, collects on the bath surface, and is recovered occasionally by suction or other adequate conventional techniques through an access port 20.

Constructed basically in common with the arrangement of FIG. 1, the cell 21 of FIG. 2 comprises a vessel 22 with the insulative layer 23 and outside shell 24. While the anode 25 similarly has a surface provided with several similar overhanging projections 26 and similar communication holes 27 bridging between the anode 25 surface and the vertical bore 28, the latter, in contrast, is formed separately at several positions in the vicinity of the surface within the anode body. The cathode 29 comprises a vertical series of downward convergent conical rings 30, each supported at several points with steel plates 31, 32, which are held on the wall of the vessel 22 and through which power is to be supplied. Such rings may be reinforced as necessary with one or more vertical bars or rods fixed thereto on or in a periphery thereof. A thus constructed cathode arrangement allows the metallic product to pass through the gaps to behind the electrode and, thus, minimizes effectively the possible contact of the metal with any chlorine gas to come in the interelectrode space. The anode 25 has a lead block 33 for power supply, which in this illustrated example is hollow with an axial cavity, inserted with a tube 34 through which coolant air is forcibly passed into the cavity for efficiently cooling the lead and, thus, permitting an increased power input.

The chlorine gas is accumulated through the lateral communication holes 27 and rise bores 28 to an upper space of the vessel is adjacency with the anode, and recovered through the gas outlet 35. Ports 37 and 38 are provided in a lid 36 for occasional observation and clearing the electrodes therethrough. A furhter port 39 is arranged for loading of the electrolyte and unloading of the metal.

The illustrated example is also provided in a lower portion of the vessel with an annular chamber 40, which has a tube 41 connected to a top thereof for supplying and removing inert gas, and several opening 42 formed in inner and outer walls thereof in a bottom portion. This arrangement allows the cell to operate at substantially regular bath levels by initially reserving a bath or, especially, the consumable component of the bath, and supplying the inert gas to press out the bath to outside said chamber, so that said bath or bath component joins and raises back the bath level which has been lowered somewhat by consumption with the process going on. This technique reduces the frequency of charging of the salt and accordingly the time of exposure to the atmospheric air which would deteriorate the product, thus improving in both labor cost and product yield.

Although the electrode assembly of the invention may be arranged singly in each vessel as set forth in the above description, it is also possible that several assemblies be contained in a common vessel as illustrated below. The vessel 47 of FIG. 3, which is coated with an insulative layer 45 and a steel shell 46, contains five such assemblies of anode 48 and cathode 49 with an electrolyte reserve chamber 50 of an annular construction similar to that of FIG. 2, positioned at a regular interval. Among the assemblies in the vessel 47, a closed vertical tank 51 of steel is further provided for accumulating the metallic product.

An electrolyte bath loaded through a tube 59 to a level somewhat above the cathode top, electrolytic process is conducted by supplying an adequate power input through the vessel 47 and leads 52 to the electrodes. The product metal is guided through gaps in the cathode and support members 53 to behind the cathode, rises to the bath surface, enters to collect in the tank 51 from an inlet opening 54, which is regulatable mechanically or other conventional way, at or close to the bath level, and taken out through an outlet duct 55 from the bottom by pressing the liquid with an inert gas such as argon forced into said tank through a tube 60. The other product, chlorine gas, like the above given examples, is collected once under the jalousie-like projections, guided through communication holes 56 and rise bores 57 to the free space over the bath, and then recovered therefrom through gas outlets port 58.

EXAMPLE

An arrangement basically illustrated in FIG. 2 was employed, which comprised a steel vessel, 1.44 m in I.D. 3 m in length, and 3 cm in wall thickness, coated with a layer of silica insulative and a steel shell. A 100 KW heater was used to heat the bottom portion. As anode a 2.4 m long cylindrical shaft of graphite was employed with a 1.2 m long lower portion provided with eight annular projections in series, each 75 cm in O.D. and 67 cm in I.D. 16 communication holes, each 2 cm in diameter, were formed with an inward ascent of 30° to the horizontal and positioned at a regular interval. At the inner end 30 cm apart from the axis, each hole was joined with its respective rise bore 3 cm in diameter and extending axially. The cathode was a 1 m long arrangement of eight conical steel rings of 80 cm in I.D.

Charged with a molten salt composed of 45% NaCl—25% KCl—30% $MgCl_2$ on weight basis, the cell was operated with a power input of 12.5 KA at 3.8 V over the electrodes. Once every four hours argon gas was supplied to the bath reserve chamber to raise by 3 cm or so the bath level to compensate the decrease. 124 Kg of magnesium metal was yielded along with 360 Kg of chlorine gas, as a result of the 24 hour-long electrolysis.

As may have been apparent from the above description, the cell arrangement of the invention has several advantages to conventional designs:

1. The yield loss due to the recombination in the cell has been substantially reduced as a result of effectively separated paths provided for each product, the chlorine is guided and allowed to pass within the body of the anode, while or not the metal passing behind the cathode;

2. A substantially higher power efficiency is achievable due to the substantially decreased interelectrode spacing now available, safely from the wasteful recombination of once forming products; and additionally:

3. With the electrolyte bath reserve chamber built in the vessel and gas pumping system connected thereto, the cell further allows to save labor by decreasing the frequency of electrolyte charge to the vessel.

4. With the metal collecting tank immersed in the bath inside the electrolysis vessel, the cell requires only a separate metal storage tank, if any, of substantially decreased volume capacity, or even no such tank at all, thus permitting a reduction in plant investment, in addition to the decreased frequency of metal tapping;

5. The elongated construction of the metal collecting tank, extending vertically in the bath, helps much to minimize the temperature difference between different levels of the bath, due to the metallic content which exhibits a high thermal conductivity. This makes a vessel of increased length available with a less powered heater alone at the bottom, and no specialized heater for eliminating the temperature difference;

6. The inert gas pressurizing system allows to recover safely from the tank even such active product mctal as lithium or sodium, as there is no need any more to remove the lid for recovering.

Electric cell for a molten salt comprising alkali- or alkaline earth metal chloride.

I claim:

1. An electrolytic cell for a molten salt comprising alkali or alkaline earth metal chloride, comprising: an assembly of anode and cathode in opposed relation with each other, said anode being substantially of cylindrical construction, a tightly closable vessel containing said assembly and capable of holding in molten state a salt comprising an alkali or alkaline earth metal chloride, an several projections formed to a length on an effective side of the anode opposed to the cathode an insulative sleeve arranged around the anode above said projections, said projection having upper and lower surfaces declining outwards so an open bottom-closed top space is provided under each projection, a rise bore formed lengthwise within the anode to run along the axis, and a lateral hole in communicating relation with an inward ascent between said space and rise bore.

2. The cell as claimed in claim 1, in which said space is formed in multiplicity at different levels.

3. The cell as claimed in claim 1, in which said space is formed spirally around a cylindrical surface of the anode.

4. The cell as claimed in claim 1, in which said cathode comprises a thin-walled straight cylinder of steel.

5. The cell as claimed in claim 1, in which said cathode comprises several thin-walled annular members of steel.

6. The cell as claimed in claim 5, in which at least one of said annular members is straight along the axis.

7. The cell as claimed in claim 5, in which at least one of said members is downward convergent.

8. The cell as claimed in claim 1, in which said chloride is one selected from lithium, sodium, and magnesium.

9. The cell as claimed in claim 1, in which said cathode comprises a corresponding number of conical ring elements to that of the projections of the anode, each of said elements is in an opposed relation with the slanted surface of the projection.

* * * * *